US008200481B2

(12) United States Patent
Xu et al.

(10) Patent No.: US 8,200,481 B2
(45) **Date of Patent: *Jun. 12, 2012**

(54) METHOD AND DEVICE FOR PERFORMING FRAME ERASURE CONCEALMENT TO HIGHER-BAND SIGNAL

(75) Inventors: Jianfeng Xu, Shenzhen (CN); Lei Miao, Shenzhen (CN); Chen Hu, Shenzhen (CN); Qing Zhang, Shenzhen (CN); Lijing Xu, Shenzhen (CN); Wei Li, Shenzhen (CN); Zhengzhong Du, Shenzhen (CN); Yi Yang, Shenzhen (CN); Fengyan Qi, Shenzhen (CN); Wuzhou Zhan, Shenzhen (CN); Dongqi Wang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 1000 days.

This patent is subject to a terminal disclaimer.

(21) Appl. No.: 12/129,118

(22) Filed: May 29, 2008

(65) Prior Publication Data

US 2009/0076805 A1 Mar. 19, 2009

(30) Foreign Application Priority Data

Sep. 15, 2007 (CN) ..... 2007 1 0153955
Nov. 24, 2007 (CN) ..... 2007 1 0194570

(51) Int. Cl.
*G10L 11/04* (2006.01)
*G10L 19/00* (2006.01)

(52) U.S. Cl. ..... 704/206; 704/500

(58) Field of Classification Search ..... 704/206
See application file for complete search history.

(56) References Cited

U.S. PATENT DOCUMENTS 5,907,822 A 5/1999 Prieto, Jr.
5,943,347 A 8/1999 Shepard
6,691,085 B1 2/2004 Rotola-Pukkila et al.
6,985,856 B2 1/2006 Wang et al.
7,069,208 B2 6/2006 Wang
(Continued)

FOREIGN PATENT DOCUMENTS

CN 1418361 A 5/2003
(Continued)

OTHER PUBLICATIONS

Korean Intellectual Property Office, Examination Report in Korean Patent Application No. 10-2008-0059133 (Mar. 31, 2010).

(Continued)

*Primary Examiner* — Justin Rider
(74) *Attorney, Agent, or Firm* — Leydig, Voit & Mayer, Ltd.

(57) ABSTRACT

The present invention discloses a method for performing a frame erasure concealment to a higher-band signal, including: calculating a periodic intensity of a higher-band signal with respect to a lower-band signal; judging whether the periodic intensity of the higher-band signal is higher than or equal to a preconfigured threshold; if the periodic intensity of the higher-band signal is higher than or equal to the preconfigured threshold, using a pitch period repetition method to perform the frame erasure concealment to the higher-band signal of a current lost frame; and if the periodic intensity of the higher-band signal is lower than the preconfigured threshold, using a previous frame data repetition method to perform the frame erasure concealment to the higher-band signal of the current lost frame. The present invention further discloses a device for performing a frame erasure concealment to a higher-band signal and a speech decoder. The problem that the quality of the voice signal is lowered is avoided.

21 Claims, 3 Drawing Sheets

U.S. PATENT DOCUMENTS

| | | | |
|---|---|---|---|
| 7,080,006 | B1 | 7/2006 | Kupferschmidt et al. |
| 7,233,897 | B2 | 6/2007 | Kapilow |
| 2002/0097807 | A1 | 7/2002 | Gerrits |
| 2003/0036382 | A1 | 2/2003 | Chen |
| 2003/0036901 | A1 | 2/2003 | Chen |
| 2003/0163304 | A1 | 8/2003 | Mekuria et al. |
| 2003/0220787 | A1 | 11/2003 | Svensson et al. |
| 2004/0002856 | A1 | 1/2004 | Bhaskar et al. |
| 2004/0250195 | A1 | 12/2004 | Toriumi |
| 2005/0055204 | A1 | 3/2005 | Florencio et al. |
| 2005/0143985 | A1 | 6/2005 | Sung et al. |
| 2005/0154584 | A1 | 7/2005 | Jelinek et al. |
| 2005/0187764 | A1 | 8/2005 | Chen |
| 2005/0246164 | A1 | 11/2005 | Ojala et al. |
| 2006/0173687 | A1 | 8/2006 | Spindola |
| 2006/0184861 | A1 | 8/2006 | Sun et al. |
| 2006/0265216 | A1 | 11/2006 | Chen |
| 2007/0078645 | A1 | 4/2007 | Niemisto et al. |
| 2007/0177620 | A1 | 8/2007 | Ohmuro et al. |
| 2007/0225971 | A1 | 9/2007 | Bessette |
| 2007/0233467 | A1 | 10/2007 | Oshikiri |
| 2007/0299669 | A1 | 12/2007 | Ehara |
| 2008/0027717 | A1 | 1/2008 | Rajendran et al. |
| 2008/0040122 | A1 | 2/2008 | Chen et al. |
| 2008/0046236 | A1 | 2/2008 | Thyssen et al. |
| 2008/0052065 | A1 | 2/2008 | Kapoor et al. |
| 2008/0071550 | A1 | 3/2008 | Oh et al. |
| 2008/0126082 | A1 | 5/2008 | Ehara et al. |
| 2008/0126096 | A1 | 5/2008 | Oh et al. |
| 2008/0249766 | A1 | 10/2008 | Ehara |
| 2009/0141790 | A1 | 6/2009 | Kawashima et al. |

FOREIGN PATENT DOCUMENTS

| | | | |
|---|---|---|---|
| CN | 1484824 | A | 3/2004 |
| CN | 1489762 | A | 4/2004 |
| CN | 1930607 | A | 3/2007 |
| CN | 100524462 | C | 8/2009 |
| EP | 1801784 | A1 | 6/2007 |
| EP | 1808684 | A1 | 7/2007 |
| JP | H11-30997 | A | 2/1999 |
| JP | 2004-302259 | A | 10/2004 |
| JP | 2004-361731 | A | 12/2004 |
| JP | 2005-084692 | A | 3/2005 |
| JP | 2005084692 | A | 3/2005 |
| KR | 20030044292 | A | 6/2003 |
| KR | 20090076797 | A | 7/2009 |
| WO | WO 02/058052 | A1 | 7/2002 |
| WO | WO 03/017555 | A2 | 2/2003 |
| WO | WO 2005/106848 | A1 | 11/2005 |
| WO | WO 2005/106850 | A1 | 11/2005 |
| WO | WO 2005/117366 | A1 | 12/2005 |
| WO | WO 2007/000988 | A1 | 1/2007 |
| WO | WO 2007/000998 | A1 | 1/2007 |
| WO | WO 2007/111647 | A2 | 10/2007 |

OTHER PUBLICATIONS

State Intellectual Property Office of the People's Republic of China, English Translation of Written Opinion of the International Searching Authority in International Patent Application No. PCT/CN2008/070867 (Aug. 21, 2008).

NTT, "Low-Delay Wideband Extension to G.711 for IP Phone Services," International Telecommunication Union, Telecommunication Standardization Sector, Study Period 2005-2008, ITU-T WP3/16, Document AC-0701-06, English only, Geneva (Jan. 16-19, 2007).

Rapporteur Q10/16, "Q10/16 Rapporteurs' Meeting report," Temporary Document, International Telecommunication Union, Telecommunication Standardization Sector, Study Period 2005-2008, Study Group 16, TD 228 R1 (WP 3/16), English only, Geneva (Mar. 30, 2007).

ITU, Appendix IV: A low-complexity algorithm for packet loss concealment with G.722, International Telecommunication Union, Series G: Transmission Systems and Media, Digital Systems and Networks, Nov. 2006, pp. 1-16.

Japanese Office Action (Feb. 16, 2010).

Goodman et al., "Waveform Substitution Techniques for Recovering Missing Speech Segments in Packet Voice Communications," ICASSP 86, 1986, Institute of Electronic and Electrical Engineers, Tokyo, Japan.

Perkins et al., "A Survey of Packet Loss Recovery Techniques for Streaming Audio," IEEE Network, Sep.-Oct. 2008, Institute of Electronic and Electrical Engineers, Piscataway, New Jersey.

Ramamurthy et al., "Modeling and Analysis of a Variable Bit Rate Video Multiplexer," INFOCOM'92, 1992, Institute of Electronic and Electrical Engineers, Piscataway, New Jersey.

Sanneck et al., "A New Technique for Audio Packet Loss Concealment," 1996, Institute of Electronic and Electrical Engineers, Piscataway, New Jersey.

Sjoberg et al., "RFC 4352—RTP Payload Foramt for the Extended Adaptive Multi-Rate Wideband (AMR-WB+) Audio Codec," Jan. 2006, FROM??

Wah et al., "A Survey of Error-Concealment Schemes for Real-Time Audio and Video Transmissions over the Internet," IEEE International Symposium on Multimedia Software Engineering, Dec. 2000, Institute of Electronic and Electrical Engineers, Piscataway, New Jersey.

METHOD AND DEVICE FOR PERFORMING FRAME ERASURE CONCEALMENT TO HIGHER-BAND SIGNAL

CROSS-REFERENCE TO RELATED APPLICATIONS

The present application claims the benefit of Chinese Patent Application No. 200710153955.0, filed on Sep. 15, 2007, entitled "METHOD AND DEVICE FOR PERFORMING FRAME ERASURE CONCEALMENT TO HIGHER-BAND SIGNAL", and Chinese Patent Application No. 200710194570.9, filed on Nov. 24, 2007, entitled "METHOD AND DEVICE FOR PERFORMING FRAME ERASURE CONCEALMENT TO HIGHER-BAND SIGNAL," both of which are hereby incorporated by reference in their entirety.

FIELD OF THE INVENTION

The present invention relates to the field of signal decoding techniques, and in particular to a method and device for performing a frame erasure concealment to a higher-band signal.

BACKGROUND OF THE INVENTION

In most traditional voice codecs, the bandwidth of voice signal is low. Only a few voice codecs have a wide bandwidth, with the development of the network technology, the network transmission rate increases and the requirement for the wideband codec becomes higher. Optionally, it is desirable that the bandwidth of the voice codec is up to the ultra-wideband (50 Hz-14000 Hz) and fullband (20 Hz-20000 Hz).

In order to make the wideband voice codec compatible with the traditional voice codec, a voice codec may be divided into a plurality of layers. The following description will be given with the voice codec including two layers as an example.

First, the voice codec including two layers separates the input signals into higher-band signals and lower-band signals with an analysis Quadrature-Mirror Filterbank at the coding side. The lower-band signal is input into a lower-band coder for coding and the higher-band signal is input into a higher-band coder for coding. The obtained lower-band data and higher-band data are synthesized into a bitstream via a bitstream multiplexer and the bitstream is sent out. The lower-band signal refers to a signal whose frequency is in the lower band of the bandwidth for the signal and the higher-band signal refers to a signal whose frequency is in the higher band of the bandwidth for the signal. For example, when the bandwidth of an input signal is 50 Hz-7000 Hz, the bandwidth of the lower-band signal may be 50 Hz-4000 Hz and the bandwidth of the higher-band signal may be 4000 Hz-7000 Hz. The decoding is implemented at the decoding side. The bitstream is divided into a lower-band bitstream and a higher-band bitstream, and the lower-band bitstream and the higher-band bitstream are input into the lower-band decoder and the higher-band decoder for decoding, respectively. Thus, the lower-band signal and the higher-band signal are obtained. The lower-band signal and the higher-band signal are synthesized into the voice signal to be output with a synthesis Quadrature-Mirror Filterbank.

At present, the application of Voice over IP (VoIP) and the application of the wireless network voice become more and more popular. The voice transmission requires transmitting a small data packet in realtime and reliably. When a voice frame is lost during the transmission, there is no time for resending the lost voice frame. Similarly, if a voice frame passes through a long routing and can not reach timely when the voice frame is to be played, the voice frame is equivalent to a lost frame. Thus, in the voice system, if a voice frame can not reach or can not reach in time, the voice frame may be considered as a lost frame.

If no processing is performed to the lost frame, the voice is intermittent and the voice quality is affected greatly. Thus, for the lost frame, a frame erasure concealment processing is required. In other words, the lost voice data are estimated and the estimated data are used to replace the lost data. Hence, a better voice quality may be obtained in a frame lost environment. As for the voice codec which divides the input signal into the higher-band signal and the lower-band signal, the frame erasure concealment is performed to the lower-band signal and the higher-band signal respectively during the frame erasure concealment, and the higher-band signal and the lower-band signal obtained after the frame erasure concealment are synthesized into a voice signal to be output via the synthesis Quadrature-Mirror Filterbank.

The frame erasure concealment method includes the insertion method, the interpolation method and the regeneration method.

The insertion method for the frame erasure concealment includes the splicing, the silence replacement, the noise replacement and the previous frame repetition.

The interpolation method for the frame erasure concealment includes the waveform replacement, the pitch repetition and the time domain waveform revision.

The regeneration method includes the coder parameter interpolation and the model-based regeneration method.

The model-based regeneration method has the best voice quality and the highest algorithm complexity, and the previous frame repetition method has a good voice quality and an algorithm complexity which is not high.

Because the affections on the voice quality by the lower-band signal are higher than that by the higher-band signal, a frame erasure concealment algorithm with a high complexity and a high voice quality (for example, the pitch repetition, the time domain waveform revision, the coder parameter interpolation and the model-based regeneration method) is used for the lower-band signal. A frame erasure concealment algorithm with a low complexity and a low voice quality is used for the higher-band signal. Thus, the compromise between the voice quality and the complexity is accomplished.

In the speech decoder of the prior art, the pitch repetition is used for the lower-band signal to implement the frame erasure concealment, while the previous frame repetition and attenuation method is used for the higher-band signal to implement the frame erasure concealment.

The formula for recovering the higher-band signal based on the previous frame repetition and attenuation method is as follows:

$$s_{hb}(n)=s_{hb}(n-N)\cdot\alpha, n=0, \ldots, N-1$$

In the formula, $s_{hb}(n)$, $n=0, \ldots, N-1$ represents the recovered higher-band signal of the lost frame, and N represents the number of the samples of a frame; the attenuation coefficient $\alpha$ is a nonnegative number ranging from 0 to 1. The attenuation coefficient $\alpha$ may be a constant such as 0.8 or a variable which changes adaptively according to the number of continuously lost packets. For example, the first lost frame is multiplied by a larger attenuation coefficient such as 0.9, while the second lost frame and the following frames are multiplied by a smaller attenuation coefficient such as 0.7.

In the process of realizing the invention, the inventor finds: when the signal has a strong periodicity, the higher-band signal can not be recovered correctly. When the lower-band signal and the higher-band signal have the consistent periodicity. the original periodicity of the higher-band signal is destroyed when the frame erasure concealment is performed to the higher-band signal with the prior art. Thus, the quality of the voice signal output from the speech decoder is lowered.

SUMMARY OF THE INVENTION

One embodiment of the present invention provides a method for performing a frame erasure concealment to a higher-band signal so as to improve the quality of the voice signal output from the speech decoder.

Another embodiment of the present invention provides a device for performing a frame erasure concealment to a higher-band signal so as to improve the quality of the voice signal output from the speech decoder.

Another embodiment of the present invention provides a speech decoder so as to improve the quality of the voice signal output from the speech decoder.

The technical solutions according to the embodiments of the present invention are implemented as follows to accomplish the above objects.

A method for performing a frame erasure concealment to a higher-band signal, includes:

calculating a periodic intensity of the higher-band signal with respect to pitch period information of a lower-band signal;

judging whether the periodic intensity is higher than or equal to a preconfigured threshold, if the periodic intensity is higher than or equal to the preconfigured threshold, performing the frame erasure concealment to the higher-band signal of a current lost frame with a pitch period repetition based method, if the periodic intensity is lower than the preconfigured threshold, performing the frame erasure concealment to the higher-band signal of the current lost frame with a previous frame data repetition based method.

A device for performing a frame erasure concealment to a higher-band signal, includes:

a periodic intensity calculation module, adapted to calculate a periodic intensity of the higher-band signal with respect to pitch period information of a lower-band signal, judge whether the periodic intensity is higher than or equal to a preconfigured threshold, if the periodic intensity is higher than or equal to the preconfigured threshold, transmit the higher-band signal of a current lost frame to a pitch period repetition module, and if the periodic intensity is lower than the preconfigured threshold, transmit the higher-band signal of the current lost frame to a previous frame data repetition module;

the pitch period repetition module, adapted to perform the frame erasure concealment to the higher-band signal of the current lost frame with a pitch period repetition based method; and the previous frame data repetition module, adapted to perform the frame erasure concealment to the higher-band signal of the current lost frame with a previous frame data repetition based method.

A speech decoder includes:

a bitstream demultiplex module, adapted to demultiplex an input bitstream into a lower-band bitstream and a higher-band bitstream;

a lower-band decoder and a higher-band decoder, adapted to decode the lower-band bitstream and the higher-band bitstream to a lower-band signal and a higher-band signal respectively;

a frame erasure concealment device for a lower-band signal, adapted to perform a frame erasure concealment to the lower-band signal to obtain a pitch period of the lower-band signal;

a frame erasure concealment method for a higher-band signal, adapted to calculate a periodic intensity of the higher-band signal with respect to pitch period information of the lower-band signal, determine whether the periodic intensity of the higher-band signal is higher than or equal to a preconfigured threshold; if the periodic intensity of the higher-band signal is higher than or equal to the preconfigured threshold, use a pitch period repetition based method to perform the frame erasure concealment to the higher-band signal of a current lost frame, and if the periodic intensity of the higher-band signal is lower than the preconfigured threshold, use a previous frame data repetition based method to perform the frame erasure concealment to the higher-band signal of the current lost frame; and a synthesis Quadrature-Mirror Filterbank, adapted to synthesize the lower-band signal and the higher-band signal after the frame erasure concealment, into a voice signal to be output.

In the technical solution according to one embodiment of the present invention, the periodic intensity of the higher-band signal with respect to the pitch period of the lower-band signal is calculated; then, it is determined whether the periodic intensity of the higher-band signal with respect to the pitch period information of the lower-band signal is higher than or equal to a preconfigured threshold; when the periodic intensity is higher than or equal to the threshold, the pitch period repetition based method is used to perform the frame erasure concealment to the higher-band signal of the current lost frame. Thus, when the higher-band signal has a strong periodicity, the periodicity of the higher-band signal is not destroyed while the periodicity of the higher-band signal. Hence, the problem that the quality of the voice signal is lowered because the periodicity of the higher-band signal is destroyed, can be avoided. When the periodic intensity of the higher-band signal is lower than the threshold and it is determined that the periodic intensity of the higher-band signal is weak, the previous frame data repetition based method is used to perform the frame erasure concealment to the current lost frame. When the periodic intensity of the higher-band signal is weak, the high frequency noise is introduced. Therefore, the problem that the voice quality of the voice signal is lowered because the high frequency noise is introduced, can be avoided. In this way, the technical solution for performing the frame erasure concealment to the higher-band signal according to one embodiment of the present invention can improve the quality of the voice signal output from the speech decoder.

DETAILED DESCRIPTION OF THE EMBODIMENTS

The present invention will be described in detail with reference to the accompanying drawings and the specific embodiments below.

Figure 1:
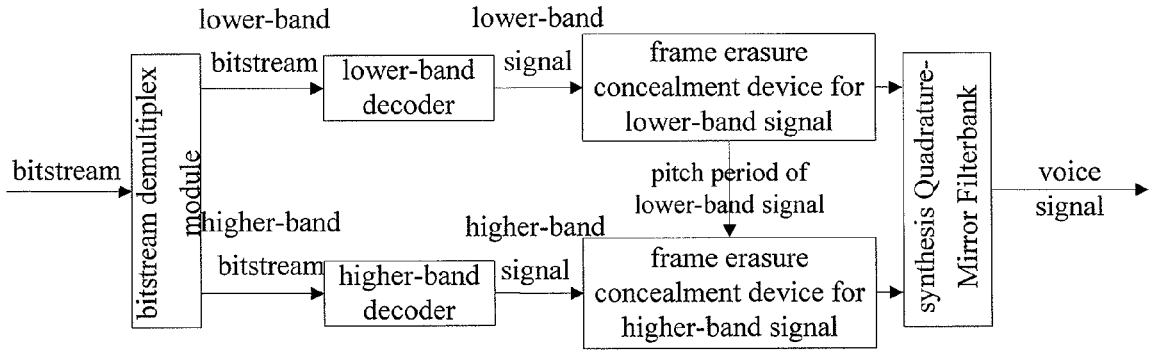
FIG. 1 is a structure diagram of the speech decoder according an embodiment of the present invention.

FIG. 1 is a structure diagram of the speech decoder according one embodiment of the present invention. As shown in FIG. 1, the speech decoder includes a bitstream demultiplex module, a lower-band decoder, a higher-band decoder, a frame erasure concealment device for a lower-band signal, a frame erasure concealment device for a higher-band signal and a synthesis Quadrature-Mirror Filterbank.

The bitstream demultiplex module is adapted to demultiplex the input bitstream into a lower-band bitstream and a higher-band bitstream. The lower-band signal and the higher-band signal are obtained by decoding the lower-band bitstream and the higher-band bitstream with the lower-band decoder and the higher-band decoder respectively. The lower-band signal and the higher-band signal are processed by the frame erasure concealment device for the lower-band signal and the frame erasure concealment device for the higher-band signal respectively, and then are synthesized by the synthesis Quadrature-Mirror Filterbank into a voice signal to be output.

The frame erasure concealment device for the lower-band signal processes the frame erasure concealment of the lower-band signal and provides the pitch period of the lower-band signal to the frame erasure concealment device for the higher-band signal.

The frame erasure concealment device for the higher-band signal performs the frame erasure concealment method for the higher-band signal according to one embodiment of the present invention. The frame erasure concealment method for the higher-band signal according to one embodiment of the present invention includes: calculating a periodic intensity of a higher-band signal with respect to the pitch period information of a lower-band signal; determining whether the periodic intensity of the higher-band signal is higher than or equal to a preconfigured threshold; if the periodic intensity of the higher-band signal is higher than or equal to the preconfigured threshold, using a pitch period repetition based method to perform the frame erasure concealment to the higher-band signal of a current lost frame, and if the periodic intensity of the higher-band signal is lower than the preconfigured threshold, using a previous frame data repetition based method to perform the frame erasure concealment to the higher-band signal of the current lost frame.

Figure 2:
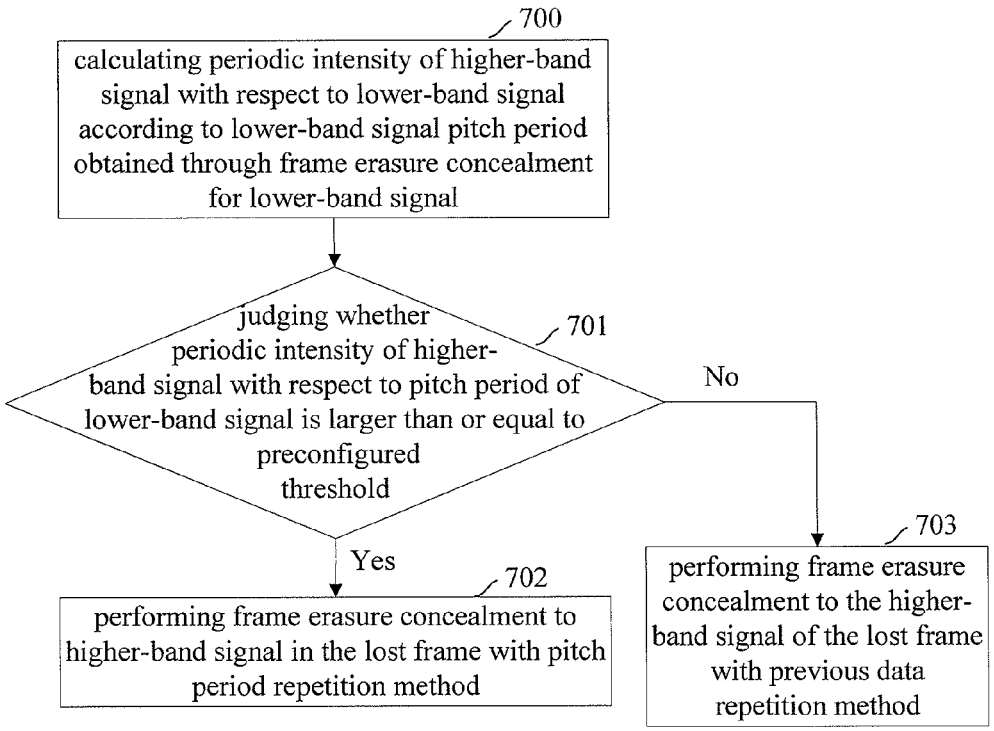
FIG. 2 is a flow char showing the frame erasure concealment method for the higher-band signal according to one embodiment of the present invention.
Figure 3:
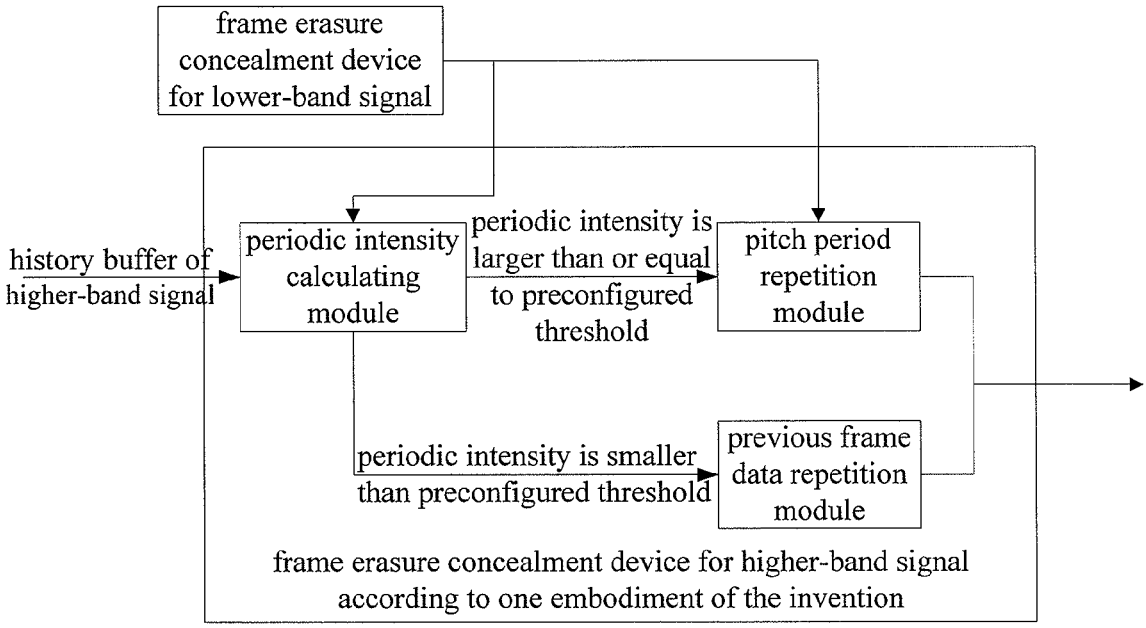
FIG. 3 is a structure diagram of the frame erasure concealment device for the higher-band signal according one embodiment of the present invention.

FIG. 2 is a flow char showing the frame erasure concealment method for the higher-band signal according to one embodiment of the present invention. FIG. 3 is a structure diagram of the frame erasure concealment device for the higher-band signal according one embodiment of the present invention. With reference to FIG. 2 and FIG. 3, the detailed descriptions of the technical solution for implementing the frame erasure concealment according to one embodiment of the present invention will be given as follows.

As shown in FIG. 2, the method for performing the frame erasure concealment to the higher-band signal includes the following steps.

Step 700: A periodic intensity of a higher-band signal with respect to a lower-band signal is calculated according to a lower-band signal pitch period which is obtained through the frame erasure concealment of the lower-band signal.

In step 700, the frame erasure concealment of the lower-band signal use a frame erasure concealment method which may obtain the pitch period, such as a pitch repetition based method, a model-based regeneration based method and a coder parameter interpolation based method, and the coder parameter includes a pitch period parameter. For example, the model-based regeneration based method may a frame erasure concealment method which implements the regeneration based on the linear predictive model.

In step 700, the frame erasure concealment device for the higher-band signal first uses the signal frame erasure concealment for the lower-band signal to calculate the pitch period of the lower-band signal $t_{lb}$ and then uses the history buffer signal of the higher-band signal $s_{hb}(n)$ to calculate the periodic intensity $r(t_{lb})$ of the higher-band signal with respect to $t_{lb}$.

Generally, the function according to evaluating the periodic intensity of signal includes the autocorrelation function and the normalized correlation function.

The pitch period of the lower-band signal may be obtained by calculating the autocorrelation function for the lower-band signal. The formula of the correlation function is as follows:

$$r(i) = \sum_{j=-N}^{-1} s_{lb}(j)s_{lb}(j-i),\ i = \text{min_pitch}, \ldots, \text{max_pitch}$$

In the formula, r(i) represents the correlation function with respect to i; $s_{lb}(j)$ represents the lower-band signals; N represents the length of the window for calculating the correlation function, such as the number of the samples for the voice signal of a frame; min_pitch is the lower limit for searching the pitch period and max_pitch is the upper limit for searching the pitch period. Thus, the pitch period of the lower-band signal is as follows:

$$t_{lb} = \arg \max_{i=min_pitch,\ldots,max_pitch} r(i);$$

in other words, $t_{lb}$ is equal to the value of i when r(i) has the maximum value.

The formula for calculating the periodic intensity of signal with the autocorrelation function is as follows.

$$r(t_{lb}) = \sum_{n=0}^{N} s_{hb}(n)s_{hb}(n-t_{lb})$$

In the formula, $s_{hb}(n)$ n=−M, . . . ,−1 represents the history buffer signal of the higher-band signal and M represents the number of the samples in the history buffer signal of the higher-band signal. N is a constant positive integer such as the number of the samples for the higher-band signal in a frame.

The formula for calculating the periodic intensity of signal with the normalized correlation function is as follows.

$$r_{nor}(t_{lb}) = \frac{\sum_{n=0}^{N-1} s_{hb}(n)s_{hb}(n-t_{lb})}{\sqrt{\sum_{n=0}^{N-1} s_{hb}^2(n)\sum_{n=0}^{79} s_{hb}^2(n-t_{lb})}}$$

In the formula, N is a constant positive integer such as the number of the samples for the higher-band signal in a frame.

Referring to FIG. 3, the frame erasure concealment device for the higher-band signal as shown in FIG. 3 includes a periodic intensity calculating module, a pitch period repetition module and a previous frame data repetition module. In step 700, the periodic intensity calculating module calculates the lower-band signal pitch period with the signal frame erasure concealment for the lower-band signal and calculates the periodic intensity of the higher-band signal with respect to the pitch period information of the lower-band signal.

In step 700, in addition to the pitch period of the lower-band signal $t_{lb}$, the pitch period information of the lower-band signal may include a value around the pitch period of the lower-band signal $t_{lb}$. The frame erasure concealment device for the higher-band signal may first calculate the pitch period of the lower-band signal $t_{lb}$ with the signal frame erasure concealment for the lower-band signal. In order to reduce the complexity for searching the pitch period of the higher-band signal and improve the accuracy for the pitch period of the higher-band signal, an interval in the pitch period of the lower-band signal $t_{lb}$, such as $[\max(t_{lb}-m, \text{pit_min}), \min(t_{lb}+m, \text{pit_max})]$, may be used to calculate the normalized correlation function for the higher-band signal. The history buffer signal of the higher-band signal $s_{hb}(n)$ is used to calculate the periodic intensity of the higher-band signal $r(t_{lb})$ with respect to $[\max(t_{lb}-m,\text{pit_min}), \min(t_{lb}+m,\text{pit_max})]$, $$r_{nor}(i) = \frac{\sum_{n=0}^{N-1} s_{hb}(n)s_{hb}(n-i)}{\sqrt{\sum_{n=0}^{N-1} s_{hb}^2(n) \sum_{n=0}^{N-1} s_{hb}^2(n-i)}},$$

$$\max(t_{lb}-m,\text{pit_min}) \leqq i \leqq \min(t_{lb}+m,\text{pit_max})$$

In the formula, m is the radius of the searching interval, such as 3 or any other value less than or equal to 3. According to experiment results, the larger the m is, the higher the accuracy is and the higher the algorithm complexity is. In this embodiment, m is equal to 3. pit_min is the minimum pitch period. In this embodiment, pit_min=16. pit_max is the maximum pitch period. In this embodiment, pit_max=144. In other embodiments, it is also allowed that pit_min=20 and pit_max=143 or pit_min=16 and pit_max=160. The pitch period for higher-band signal $t_{hb}$ is as follows:

$$t_{hb} = \arg \max_{i=\max(t_{lb}-m,\text{pit_min}),\ldots,\min(t_{lb}+m,\text{pit_max})} r_{nor}(i).$$

Correspondingly, the normalized correlation function is as follows:

$$r_{nor_max} = \max_{i=\max(t_{lb}-m,\text{pit_min}),\ldots,\min(t_{lb}+m,\text{pit_max})} r_{nor}(i).$$

Thus, the periodic intensity of the higher-band signal with respect to the pitch period information of the lower-band signal is obtained.

In step 701, it is determined whether the periodic intensity of the higher-band signal with respect to the pitch period information of the lower-band signal is higher than or equal to a preconfigured threshold. If the periodic intensity of the higher-band signal with respect to the pitch period of the lower-band signal is higher than or equal to a preconfigured threshold, step 702 is performed, otherwise, step 703 is performed.

In step 701, in the method for calculating the periodic intensity with the correlation function, a threshold R may be selected through a large number of test. For example, in a simulation, the speech decoder for implementing the frame erasure concealment method for the higher-band signal according to one embodiment of the present invention may be used to obtain voice signals output with different thresholds, then the signal to noise ratio (SNR) of the voice signals are calculated, and then a threshold corresponding to a voice signal with the maximum SNR is selected as the threshold selected in step 701. Optionally, the threshold selected in step 701 may be determined according an empirical value. If $r(t_{lb}) \geqq R$, it is determined that the history buffer signal of the higher-band signal $s_{hb}(n)$ has a strong periodic intensity with respect to $t_{lb}$, otherwise, it is determined that the history buffer signal of the higher-band signal $s_{hb}(n)$ does not have a strong periodic intensity with respect to $t_{lb}$.

In the method for calculating the periodic intensity with the normalized correlation function, the threshold may be a non-negative number ranging from 0 to 1. The $R_{nor}$, such as 0.7, may be selected through a large number of test. The processes are the same as those in the method for calculating the periodic intensity with the correlation function. Optionally, an empirical value may be selected. If $r_{nor}(t_{lb}) \geqq R_{nor}$ or $r_{nor_max} \geqq R_{nor}$, it is determined that the history buffer signal of the higher-band signal $s_{hb}(n)$ has a strong periodic intensity with respect to the pitch period information of the lower-band signal, otherwise, it is determined that the history buffer signal of the higher-band signal $s_{hb}(n)$ does not have a strong periodic intensity with respect to the pitch period information of the lower-band signal.

In the frame erasure concealment device for the higher-band signal as shown in FIG. 3, the periodic intensity calculating module calculates the periodic intensity of the higher-band signal with respect to the pitch period information of the lower-band signal, then judges whether the calculated periodic intensity of the higher-band signal with respect to the pitch period information of the lower-band signal is higher than or equal to a threshold preconfigured in the periodic intensity calculating module. If the calculated periodic intensity is higher than or equal to the threshold, the pitch period repetition module performs subsequent processes; otherwise, the previous frame data repetition module performs subsequent processes.

In step 702, the pitch period repetition method is used to perform the frame erasure concealment of the higher-band signal in the lost frame.

In step 702, the pitch period repetition method includes a pitch repetition method, a model-based regeneration based method or a pitch repetition and attenuation based method.

In step 702, for example, when the pitch repetition is used to perform the frame erasure concealment to the higher-band signal. The following formula is used to regenerate the higher-band signal of the lost frame:

$$s_{hb}(n)=s_{hb}(n-t_{lb}), n=0, \ldots, N-1.$$

In the formula, $s_{hb}(n)$, n=0, . . . , N−1 represents the recovered higher-band signal of the lost frame, and N represents the number of the samples contained in a frame. $s_{hb}(n)$, n=−M, . . . ,−1 represents the history buffer signal of the higher-band signal and M represents the number of the samples in the history buffer signal of the higher-band signal.

When the frame erasure concealment is performed to the higher-band signal by simply repeating the periodicity, in the case of a large number of continuously lost frames, a signal with an excessive periodicity may be caused. In order to enhance the effect, the recovered signals are multiplied by an attenuation coefficient α. The pitch period repetition method includes the pitch repetition and attenuation based method, the frame erasure concealment is performed to the higher-band signal of the current lost frame. The obtained higher-band signal is as follows:

$$s_{hb}(n)=s_{hb}(n-t_{lb})\cdot\alpha, n=0, \ldots, N-1.$$

In the formula, N represents the number of the samples of a frame; the attenuation coefficient α is a nonnegative number ranging from 0 to 1. The attenuation coefficient α may be a constant such as 0.8, or a variable which changes adaptively according to the number of continuously lost packets. For example, for the first lost frame, a larger attenuation coefficient such as 0.9 is multiplied; for the second lost frame and the following frames, a smaller attenuation coefficient such as 0.7 is multiplied. The method for determining the threshold may also be used to determine the attenuation coefficient and repeated descriptions thereof are omitted.

the pitch repetition and attenuation based method, the frame erasure concealment is performed to the higher-band signal of the current lost frame. Furthermore, in the case that the frame erasure concealment is based on the Modified Discrete Cosine Transform (MDCT), the signal of two frames $s'_{hb}(n)$ are first duplicated through the pitch period repetition:

$$s'_{hb}(n)=s_{hb}(n-t_{lb}), n=0, \ldots, 2N-1.$$

The signal $s'_{hb}(n)$ is added with the sinusoid window $s_{tdac}(n)$ and is attenuated, and an estimated value $d^{cur}(n)$ of the Invert Modified Discrete Cosine Transform (IMDCT) coefficient for current frame is obtained as follows:

$$d^{cur}(n)=w_{tdac}(n)s_{hb}(n)\beta, n=0, \ldots, 2N-1.$$

β is an attenuation factor, such as $\sqrt{2/2}$. $d^{cur}(n)$ is overlap-added with the IMDCT coefficient $d^{pre}(n)$ of the previous frame and is attenuated, thus the output signal of the current frame is obtained as follows:

$$s_{hb}(n)=(w_{tdac}(n+N)d^{pre}(n+N)+w_{tdac}(n)d^{cur}(n))\alpha, \quad n=0, \ldots, N-1.$$

the latter frame of the IMDCT coefficient $d^{pre}(n)$ of the previous frame is called as the latter part of the IMDCT coefficient of the previous frame. The attenuation coefficient α may be a nonnegative number ranging from 0 to 1. The attenuation coefficient α may be a constant such as 0.8 or a variable which changes adaptively according to the number of continuously lost packets, such as $\alpha=1-0.005\times(n+1)$. The attenuation is increased point by point and thus the output signal becomes smoother.

Figure 4:
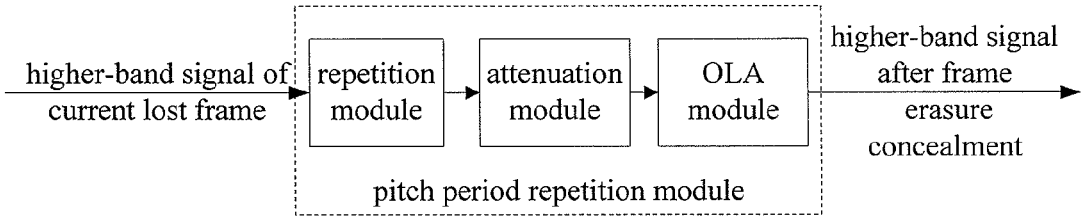
FIG. 4 is a structure diagram of the pitch period repetition module according one embodiment of the present invention.

FIG. 4 shows a pitch period repetition module according one embodiment of the present invention, including: a repetition module, adapted to duplicate a signal of a frame according to a pitch period; an attenuation module, adapted to add a sinusoid window to a duplicated signal of the frame and attenuate the signal to obtain an estimated value of the IMDCT coefficient for the frame; and an overlap-add (OLA) module, adapted to overlap-add the estimated value of current frame with the latter frame of IMDCT coefficient of a previous frame and attenuate.

In step 702, when the frame erasure concealment is performed to the higher-band signal with the regeneration based method based on the linear predictive model, the following formula is used to implement the pitch period repetition for the higher-band residual signal $e_{hb}(n)$:

$$e_{hb}(n)=e_{hb}(n-t_{lb}), n=0, \ldots, N-1.$$

In the formula $e_{hb}(n)$, n=0, . . . ,N−1 represents the higher-band residual signal of the current lost frame; and $e_{hb}(n)$, n=−M, . . . ,−1 represents the residual of the history buffer signal of the higher-band signal with respect to the linear predictive analysis.

Then, the higher-band signal of the lost frame is obtained with the residual of the higher-band signal via the linear predictive synthesizer. The formula is as follows:

$$s_{hb}(n) = e(n) - \sum_{i=1}^{8} a_i s_{hb}(n-i), n = 0, \ldots, N-1$$

Optionally, in order to enhance the subjective effect, the recovered signals are multiplied by an attenuation coefficient α, and the higher-band signal which is obtained by performing the frame erasure concealment with the regeneration method based on the linear predictive model is as follows:

$$s_{hb}(n) = \left(e(n) - \sum_{i=1}^{8} a_i s_{hb}(n-i)\right)\cdot\alpha, n = 0, \ldots, N-1.$$

In the formula, $s_{hb}(n)$, n=0, . . . ,N−1 represents the recovered higher-band signal of the current lost frame, and N represents the number of the samples in a frame. $s_{hb}(n)$, n=−M, . . . ,−1 represents the history buffer signal of the higher-band signal and M represents the number of the samples in a higher-band signal. The attenuation coefficient α may be a nonnegative number ranging from 0 to 1. The attenuation coefficient α may be a constant such as 0.8, or a variable which changes adaptively according to the number of continuously lost packets. For example, the first lost frame is multiplied by a larger attenuation coefficient such as 0.9, while the second lost frame and the following frames are multiplied by a smaller attenuation coefficient such as 0.7.

In step 702, the pitch period repetition module shown in FIG. 3 performs the frame erasure concealment to the higher-band signal of the lost frame with the pitch period repetition based method. The pitch period repetition module may perform the frame erasure concealment to the higher-band signal with the pitch repetition based method, or perform the frame erasure concealment to the higher-band signal with the regeneration based method based on a model such as the linear predictive model method.

In step 703, the previous frame data repetition based method is used to perform the frame erasure concealment to the higher-band signal of the lost frame.

In step 703, the previous frame data repetition based method includes the previous frame repetition based method, the previous frame repetition and attenuation based method, and the coder parameter interpolation based method.

In step 703, the previous frame data repetition module shown in FIG. 3 performs the frame erasure concealment to the higher-band signal of the lost frame with the previous data repetition based method. In particular, the previous frame repetition based method, the previous frame repetition and attenuation based method or the coder parameter interpolation based method may be used.

For example, when the previous frame repetition and attenuation method is used, the time domain data of the previous frame of the current lost frame is duplicated into the current lost frame and an attenuation coefficient α is multiplied. In other word, the following formula may be used to recover the lost frame:

$$s_{hb}(n)=s_{hb}(n-N)\cdot\alpha, n=0, \ldots, N-1.$$

In the formula, N represents the number of the samples contained in a frame. The attenuation coefficient α may be a nonnegative number ranging from 0 to 1. The attenuation coefficient α may be a constant such as 0.8 or a variable which changes adaptively according to the number of continuously lost packets. For example, the first lost frame is multiplied by a larger attenuation coefficient such as 0.9, while the second lost frame and the following frames are multiplied by a smaller attenuation coefficient such as 0.7.

Figure 5:
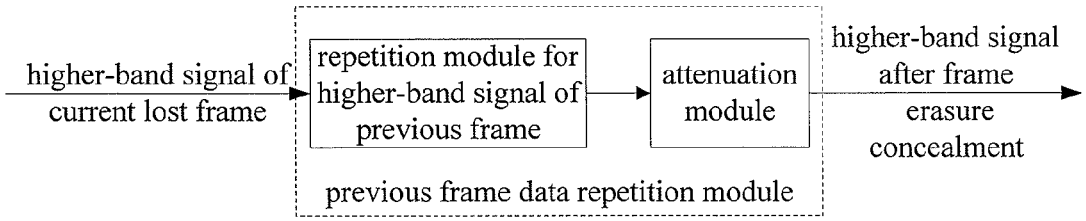
FIG. 5 is a structure diagram of a previous frame data repetition module according to one embodiment of the present invention.

FIG. 5 shows a previous frame data repetition module according one embodiment of the present invention. As shown in FIG. 5, the previous frame data repetition module includes a repetition module for a higher-band signal of a previous frame, adapted to duplicate the higher-band signal of the previous frame into the current lost frame and input the duplicated frame into an attenuation module; the attenuation module, adapted to multiply the duplicated frame by the attenuation coefficient α to obtain the higher-band signal after the frame erasure concealment.

If the algorithm of the higher-band signal decoder is a frequent domain algorithm, the previous frame repetition and attenuation based method is used to repeat and attenuate some intermediate data during recovering the time domain data from the frequent domain data of the previous frame, including: using an intermediate data which is obtained during recovering a time domain data from a frequent domain data of the previous frame of the current lost frame, as the intermediate data of the current lost frame and attenuating the intermediate data, and synthesizing the attenuated time domain data of the current lost frame with the intermediate data of the current lost frame; or, using the intermediate data which is obtained during recovering the time domain data from the frequent domain data of the previous frame and is attenuated, as the intermediate data of the current lost frame, and then the time domain data of the lost frame is synthesized with the intermediate data.

For example, when the higher-band decoder is a higher-band decoder which is based on the MDCT, the IMDCT coefficient of the previous frame may be repeated and attenuated to estimate the IMDCT coefficient of the current lost frame. According to the synthesis formula, the IMDCT coefficient of the previous frame and the IMDCT coefficient of the current lost frame are overlap-added to obtain the time domain data of the current lost frame.

The IMDCT coefficient of the current lost frame may be estimated with the following formula:

$$d^{cur}(n)=d^{pre}(n)\cdot\alpha, n=0, \ldots, 2N-1.$$

In the formula, $d^{cur}(n)$ is the IMDCT coefficient of the current lost frame, $d^{pre}(n)$ is the IMDCT coefficient of the previous frame, N represents the number of the samples contained in a frame. The attenuation coefficient α is a nonnegative number ranging from 0 to 1. The attenuation coefficient α may be a constant such as 0.8 or a variable which changes adaptively according to the number of continuously lost packets. For example, the first lost frame is multiplied by a larger attenuation coefficient such as 0.9, while the second lost frame and the following frames are multiplied by a smaller attenuation coefficient such as 0.7.

The time domain data of the current lost frame is obtained by performing the OLA to the IMDCT coefficient with the following formula:

$$s_{hb}(n)=w_{tdac}(n+N)d^{pre}(n+N)+w_{tdac}(n)d^{cur}(n), n=0, \ldots, N-1$$

In the formula, $s_{hb}(n)$ is the time domain data of the current lost frame, $w_{tdac}(n)$ is the window function to be added during the OLA synthesis, such as the hamming window and the sinusoid window. The method for determining the window function is the same as the method for determining the window function during calculating the $s_{hb}(n)$ in the prior art.

Figure 6:
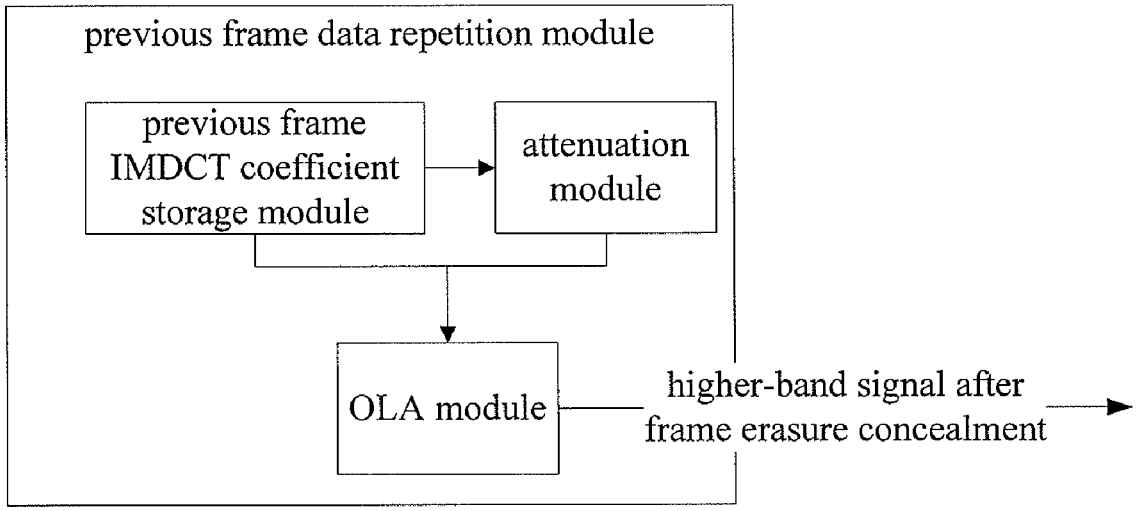
FIG. 6 is a structure diagram of another previous frame data repetition module according to one embodiment of the present invention.

FIG. 6 is a structure diagram of another previous frame data repetition module according to one embodiment of the present invention. As shown in FIG. 6, the previous frame data repetition module includes a previous frame IMDCT coefficient storage module, an attenuation module and an OLA module. The previous frame IMDCT coefficient storage module is adapted to store IMDCT coefficient during recovering the time domain data from the frequent domain data. The attenuation module is adapted to attenuate the IMDCT coefficient with α to obtain the IMDCT coefficient of the current lost frame. The IMDCT coefficient of the previous frame and the IMDCT coefficient of the current lost frame obtained after the attenuation are input into the OLA module for overlap-adding. Then, the higher-band signal of the current lost frame after the frame erasure concealment is obtained.

If the MDCT coefficient instead of the IMDCT coefficient is repeated and attenuated, the IMDCT is performed to the MDCT coefficient to obtain the IMDCT coefficient, and the IMDCT coefficient is attenuated. The time domain data of the current lost frame is obtained through the OLA process. However, the calculation amount of the IMDCT process is further added. Those skilled in the art can appreciate that, if the IMDCT coefficient of the previous frame is repeated and attenuated directly and the time domain data of the current lost frame is synthesized with the OLA process, the calculation amount can be reduced.

Moreover, for example, when the higher-band decoder is a higher-band decoder based on fast fourier transform (FFT), the invert fast fourier transform (IFFT) coefficient of the previous frame may be repeated and attenuated to estimate the IFFT coefficient of the current lost frame. Then, the OLA is performed to obtain the time domain data of the current lost frame.

The IFFT coefficient of the current lost frame may be estimated with the following formula:

$$d^{cur}(n)=d^{pre}(n)\cdot\alpha, n=0, \ldots, M-1$$

In the formula, $d^{cur}(n)$ is the IFFT coefficient of the current lost frame, $d^{pre}(n)$ is the IFFT coefficient of the previous frame, M represents the number of the IFFT coefficients required by a frame. Generally, M is larger than N which represents the number of the samples in a frame. The attenuation coefficient α is a nonnegative number ranging from 0 to 1. The attenuation coefficient α may be a constant such as 0.875 or a variable which changes adaptively according to the number of continuously lost packets. For example, the first lost frame is multiplied by a larger attenuation coefficient such as 0.9, while the second lost frame and the following frames are multiplied by a smaller attenuation coefficient such as 0.7.

The (M−N) samples before the current lost frame are recovered with the following OLA formula:

$$s_{hb}(n)=w(n+N)d^{pre}(n+N)+w(n)d^{cur}(n), n=0, \ldots, M-N-1.$$

In the formula, $s_{hb}(n)$ is the time domain data of the current lost frame, w(n) is the window function to be added during the OLA synthesis, such as the hamming window and the sinusoid window.

The (2N−M) samples after the current lost frame are recovered with the following formula:

$$s_{hb}(n)=d^{cur}(n), n=M-N, \ldots, N-1$$

In the formula, M is the number of the IFFT coefficients required by a frame and N is the number of the samples of a frame.

Except for the two layer codec, the speech decoder may further include a multi-layer decoder including a core layer and an enhance layer. The core codec is a traditional narrowband or wideband codec. Some enhance layers are extended based on the core layer of the core codec. Thus, the core layer may intercommunicate with corresponding traditional voice codec directly. The enhance layer includes a lower-band enhance layer adapted to improve the voice quality of the lower-band voice signal and a higher-band enhance layer adapted to expand the voice bandwidth. For example, the narrowband signal is expanded to the wideband signal, or the wideband signal is expanded to the ultra-wideband signal, or the ultra wideband signal is expanded to the fullband signal. However, the speech decoder including at least two layers synthesizes the signals of different layers which have been decoded into the lower-band signal and the higher-band signal and performs the frame erasure concealment processing respectively, thus the voice signal to be output from the speech decoder is obtained. Therefore, the technical solution for performing the frame erasure concealment to the higher-band signal according to one embodiment of the present invention is also applicable to the multilayer decoder including the core layer and the enhance layer.

As can be seen from the above descriptions, according to the technical solution provided according to one embodiment of the present invention, the periodic intensity of the higher-band signal with respect to the pitch period information of the lower-band signal is calculated; then, it is determined whether the periodic intensity of the higher-band signal with respect to the pitch period information of the lower-band signal is higher than or equal to a preconfigured threshold; if the periodic intensity is higher than or equal to the preconfigured threshold, the pitch period repetition based method is used to perform the frame erasure concealment to the higher-band signal of the current lost frame. Thus, when the higher-band signal has a strong periodicity, the periodicity of the higher-band signal is not destroyed while the periodicity of the higher-band signal is destroyed. Hence, the problem that the quality of the voice signal is lowered because the periodicity of the higher-band signal is destroyed, can be avoided.

Moreover, according to one embodiment of the present invention, the pitch period of the lower-band signal is obtained when the frame erasure concealment is performed to the lower-band signal and the periodic intensity of the higher-band signal with respect to the pitch period information of the lower-band signal is calculated. Thus, the hardware overhead of configuring the periodicity intensity calculation module can be decreased.

When the periodic intensity of the higher-band signal is lower than the threshold and it is determined that the periodic intensity of the higher-band signal is weak, the previous frame data repetition based method is used to perform the frame erasure concealment to the current lost frame. When the periodic intensity of the higher-band signal is weak, the high frequency noise is introduced. Therefore, the problem that the voice quality of the voice signal is lowered because the high frequency noise is introduced, can be avoided. In this way, the technical solution for performing the frame erasure concealment to the higher-band signal according to one embodiment of the present invention can improve the quality of the voice signal output from the speech decoder.

Moreover, when the algorithm of the higher-band signal decoder is a frequent domain algorithm, the intermediate data during recovering the time domain data from the frequent domain data of the previous frame may be used to perform the frame erasure concealment to the higher-band signal of the current lost frame. When the higher-band signal is encoded based on the MDCT, the IMDCT coefficient obtained from the decoder may be repeated and attenuated, then the OLA process is performed to recover the time domain data of the current lost frame. Thus, the calculation amount can be reduced.

The skilled person in the art will readily appreciate that the present invention may be implemented using either hardware, or software, or both. Embodiments within the scope of the present invention also include computer-readable media for carrying or having computer-executable instructions, computer-readable instructions, or data structures stored thereon. Such computer-readable media can include physical storage media such as RAM, ROM, other optical disk storage, or magnetic disk storage. The program of instructions stored in the computer-readable media is executed by a machine to perform a method. The method may include the steps of any one of the method embodiments of the present invention.

The above embodiments are provided for illustration only and the order of the embodiments can not be considered as a criterion for evaluating the embodiments. In addition, the expression "step" in the embodiments does not intend to limit the sequence of the steps for implementing the present invention to the sequence as described herein.

Additional advantages and modifications will readily occur to those skilled in the art. Therefore, the invention in its broader aspects is not limited to the specific details and representative embodiments shown and described herein. Accordingly, various modifications and variations may be made without departing from the scope of the invention as defined by the appended claims and their equivalents.

What is claimed is:

1. A method for performing a frame erasure concealment to a higher-band signal, comprising:

calculating, by a device for performing a frame erasure concealment to a higher-band signal, a periodic intensity of the higher-band signal with respect to pitch period information of a lower-band signal;

judging, by the device for performing the frame erasure concealment to the higher-band signal whether the periodic intensity is higher than or equal to a preconfigured threshold, if the periodic intensity is higher than or equal to the preconfigured threshold, performing the frame erasure concealment to the higher-band signal of a current lost frame with a pitch period repetition based method, and if the periodic intensity is lower than the preconfigured threshold, performing the frame erasure concealment to the higher-band signal of the current lost frame with a previous frame data repetition based method;

wherein the higher-band signal is a voice signal.

2. The method according to claim 1, wherein, the pitch period information of the lower-band signal comprises a pitch period of the lower-band signal and an interval in the pitch period of the lower-band signal, a first border of the interval being a larger one of a value which is obtained by subtracting m from the pitch period of the lower-band signal and a minimum pitch period, a second border of the interval being a smaller one of a value which is obtained by adding m to the pitch period of the lower-band signal and a maximum pitch period, and m being smaller than or equal to 3.

3. The method according to claim 1, further comprising:

obtaining, by the device for performing the frame erasure concealment to the higher-band signal, the pitch period of the lower-band signal through a frame erasure concealment process of the lower-band signal.

4. The method according to claim 1, wherein, calculating the periodic intensity of the higher-band signal with respect to the pitch period information of the lower-band signal comprises: calculating the periodic intensity of the higher-band signal with respect to the pitch period information of the lower-band signal via an autocorrelation function and a normalized correlation function with a history buffer signal of the higher-band signal of a current lost frame.

5. The method according to claim 4, wherein, the pitch period repetition based method comprises: a pitch repetition based method, a pitch repetition and attenuation based method and a model-based regeneration method.

6. The method according to claim 1, wherein, the pitch period repetition based method comprises: a pitch repetition based method, a pitch repetition and attenuation based method and a model-based regeneration method.

7. The method according to claim 6, wherein, performing the frame erasure concealment to the higher-band signal of the current lost frame with the pitch repetition and attenuation based method comprises: duplicating a history buffer signal of the higher-band signal based on the pitch period, adding a sinusoid window to a duplicated signal and attenuating a windowed signal to obtain an estimated value of an Invert Modified Discrete Cosine Transform (IMDCT) coefficient of the current frame; overlap-adding and attenuating the estimated value with a latter part of IMDCT coefficient of a previous frame.

8. The method according to claim 7, wherein, an attenuation coefficient for overlap-adding and attenuating the estimated value with the latter part of IMDCT coefficient of the previous frame is a variable which changes adaptively according to a number of continuously lost packets.

9. The method according to claim 1, wherein, the previous frame data repetition based method comprises a previous frame repetition based method, a previous frame repetition and attenuation based method and a coder parameter interpolation based method.

10. The method according to claim 9, wherein, performing the frame erasure concealment to the higher-band signal of the current lost frame with the previous frame data repetition and attenuation based method comprises: using a time domain data of a previous frame of the current lost frame, as the time domain data of the current frame and attenuating the time domain data.

11. The method according to claim 10, wherein, performing the frame erasure concealment to the higher-band signal of the current lost frame with the previous frame repetition method comprises:

using an intermediate data which is obtained during recovering a time domain data from a frequent domain data of the previous frame of the current lost frame, as the intermediate data of the current lost frame and attenuating the intermediate data, and synthesizing the attenuated time domain data of the current lost frame with the intermediate data of the current lost frame; or, using the intermediate data which is obtained during recovering the time domain data from the frequent domain data of the previous frame and is attenuated, as the intermediate data of the current lost frame; and synthesizing the time domain data of the current lost frame with the intermediate data of the current lost frame.

12. The method according to claim 9, wherein, performing the frame erasure concealment to the higher-band signal of the current lost frame with the previous frame repetition method comprises:

using an intermediate data which is obtained during recovering a time domain data from a frequent domain data of the previous frame of the current lost frame, as the intermediate data of the current lost frame and attenuating the intermediate data, and synthesizing the attenuated time domain data of the current lost frame with the intermediate data of the current lost frame; or, using the intermediate data which is obtained during recovering the time domain data from the frequent domain data of the previous frame and is attenuated, as the intermediate data of the current lost frame; and synthesizing the time domain data of the current lost frame with the intermediate data of the current lost frame.

13. The method according to claim 12, wherein, when the intermediate data is the IMDCT coefficient, the method further comprises: synthesizing the time domain data of the current lost frame with the intermediate data of the current lost frame comprises:

overlap-adding the IMDCT coefficient of the current lost frame and the IMDCT coefficient of the previous frame to obtain the time domain data of the current lost frame.

14. The method according to claim 1, further comprising:

obtaining, by the device for performing the frame erasure concealment to the higher-band signal, the pitch period of the lower-band signal through a frame erasure concealment process of the lower-band signal.

15. A tangible, non-transient computer readable medium comprising:

computer executable instructions, which, when executed by a computer unit, causes the computer unit to perform the steps according to claim 1.

16. A device for performing a frame erasure concealment to a higher-band signal, wherein the higher-band signal is a voice signal and the device comprises:

a periodic intensity calculation module, configured to calculate a periodic intensity of the higher-band signal with respect to pitch period information of a lower-band signal, judge whether the periodic intensity is higher than or equal to a preconfigured threshold, if the periodic intensity is higher than or equal to the preconfigured threshold, transmit the higher-band signal of a current lost frame to a pitch period repetition module, if the periodic intensity is lower than the preconfigured threshold, transmit the higher-band signal of the current lost frame to a previous frame data repetition module;

the pitch period repetition module, configured to perform the frame erasure concealment to the higher-band signal of the current lost frame with a pitch period repetition based method; and the previous frame data repetition module, configured to perform the frame erasure concealment to the higher-band signal of the current lost frame with a previous frame data repetition based method.

17. The device according to claim 16, wherein, the previous frame data repetition module further comprises:

a repetition module for the higher-band signal of a previous frame, configured to duplicate the higher-band signal of the previous frame into the current lost frame; and an attenuation module, configured to multiply the higher-band signal of the previous frame which is duplicated by the repetition module for the higher-band signal of the previous frame, by an attenuation coefficient to obtain the higher-band signal after the frame erasure concealment.

18. The device according to claim 16, wherein, the previous frame data repetition module comprises:

a previous frame Invert Modified Discrete Cosine Transform (IMDCT) coefficient storage module, configured to store an IMDCT coefficient during recovering a time domain data from a frequent domain data of the previous frame;

an attenuation module, adapted to attenuate the IMDCT coefficient in the previous frame IMDCT coefficient storage module to obtain the IMDCT coefficient of the current lost frame; and an OverLap-Add (OLA) module, configured to overlap-add the IMDCT coefficient of the previous frame in the previous frame IMDCT coefficient storage module and the IMDCT coefficient of the current lost frame obtained by the attenuation module, to obtain the time domain data of the current lost frame.

19. The device according to claim 16, wherein, the pitch period repetition module comprises:

a repetition module, configured to duplicate a signal of a current frame according to a pitch period;

an attenuation module, configured to add a sinusoid window to a duplicated signal and attenuate a windowed signal to obtain an estimated value of an Invert Modified Discrete Cosine Transform coefficient of the current frame; and an OverLap-Add (OLA) module, configured to overlap-add the estimated value with the latter part of the IMDCT coefficient of the previous frame and attenuate.

20. A speech decoder, comprising:

a bitstream demultiplex module, configured to demultiplex an input bitstream into a lower-band bitstream and a higher-band bitstream;

a lower-band decoder and a higher-band decoder, configured to decode the lower-band bitstream and the higher-band bitstream to a lower-band signal and a higher-band signal respectively; wherein the lower-band signal and the higher-band signal are voice signals;

a frame erasure concealment device for a lower-band signal, configured to perform a frame erasure concealment to the lower-band signal to obtain a pitch period of the lower-band signal;

a frame erasure concealment device for a higher-band signal, configured to calculate a periodic intensity of the higher-band signal with respect to pitch period information of the lower-band signal, determine whether the periodic intensity of the higher-band signal is higher than or equal to a preconfigured threshold, if the periodic intensity of the higher-band signal is higher than or equal to the preconfigured threshold, use a pitch period repetition based method to perform the frame erasure concealment to the higher-band signal of a current lost frame, and if the periodic intensity of the higher-band signal is lower than the preconfigured threshold, use a previous frame data repetition based method to perform the frame erasure concealment to the higher-band signal of the current lost frame; and a synthesis Quadrature-Mirror Filterbank, configured to synthesize the lower-band signal and the higher-band signal after the frame erasure concealment, into another voice signal to be output.

21. The speech decoder according to claim 20, wherein, the frame erasure concealment device for the higher-band signal comprises:

a periodic intensity calculating module, configured to calculate the periodic intensity of the higher-band signal with respect to the pitch period information of the lower-band signal of the current lost frame, judge whether the periodic intensity is higher than or equal to the preconfigured threshold, if the periodic intensity is higher than or equal to the preconfigured threshold, transmit the higher-band signal of the current lost frame to a pitch period repetition module, if the periodic intensity is lower than the preconfigured threshold, transmit the higher-band signal of the current lost frame to a previous frame data repetition module;

the pitch period repetition module, configured to perform the frame erasure concealment to the higher-band signal of the current lost frame with the pitch period repetition based method; and the previous frame data repetition module, configured to perform the frame erasure concealment to the higher-band signal of the current lost frame with the previous frame data repetition based method.

* * * * *